US006347562B1

(12) United States Patent
Gerber, Jr.

(10) Patent No.: US 6,347,562 B1
(45) Date of Patent: Feb. 19, 2002

(54) MULTI-PURPOSE HAND TOOL WITH MULTIPLE INTERCHANGEABLE UTILITY HEADS AND SAFETY LOCK

(76) Inventor: George R. Gerber, Jr., 176 Kearney St., Chula Vista, CA (US) 91910

( * ) Notice: Subject to any disclaimer, the term of this patent is extended or adjusted under 35 U.S.C. 154(b) by 0 days.

(21) Appl. No.: 09/663,534

(22) Filed: Sep. 15, 2000

(51) Int. Cl.[7] ..... B25D 1/02
(52) U.S. Cl. ..... 81/25
(58) Field of Search ..... 81/25, 26

(56) References Cited

U.S. PATENT DOCUMENTS

| | | | | | |
|---|---|---|---|---|---|
| 723,764 | A | * | 3/1903 | Vick | 81/25 |
| 974,021 | A | * | 10/1910 | Blake | 81/25 |
| 1,133,124 | A | * | 3/1915 | Geratt | 81/25 |
| 1,297,386 | A | * | 3/1919 | Michki | 81/25 |
| 1,757,538 | A | * | 5/1930 | Miller | 81/25 |
| 1,869,850 | A | * | 8/1932 | Hennecke | 81/25 |
| 2,462,959 | A | * | 3/1949 | Hardy | 81/25 |
| 2,763,172 | A | * | 9/1956 | Richards | 81/25 |
| 2,833,323 | A | * | 5/1958 | Strickland | 81/25 |
| RE24,831 | E | * | 5/1960 | Livermont | 81/25 |
| 2,938,412 | A | * | 5/1960 | Walker | 81/25 |
| 4,924,576 | A | * | 5/1990 | Schiller | 30/358 |
| 5,255,575 | A | * | 10/1993 | Williams | 81/25 |

* cited by examiner

*Primary Examiner*—Joseph J. Hail, III
*Assistant Examiner*—David B. Thomas
(74) *Attorney, Agent, or Firm*—Richard D. Clarke

(57) ABSTRACT

A new and improved multi-function hand tool with multiple purpose interchangeable utility heads is provided. This multi-function hand tool with multiple purpose interchangeable utility heads would have a utility head block with two utility head accepting portions providing for maximum versatility and result in a compact tool for convenient transportation and storage. The utility head block is solid to better absorb force upon impact, maintain design integrity and provide for proper weighting of the tool when used as a hammering or striking tool. The attachment mechanisms are designed to maintain integrity and optimum safety, even after consecutive, frequent usage. The utility head block is also designed to safely accommodate different hammer handles for various usage demands or if handles become damaged, thus extending the usable life of the tool. The present invention enables a user to readily selectively change the configuration of the tool that he is using to adapt the tool to various demands of an application by providing interchangeable multiple purpose utility heads and handles which quickly and safely attach to a single utility head accepting block. The overall size, weight and cost of the tool is much less than comparable conventional hand tools that it would replace. Interchangeable utility heads would be inserted into the utility head block by means of a guide shafts and held in place by a combination of a friction fit and ball/spring assembly. The handle would be held in place with the aid of wedges and a bore and tube assembly providing two safety mechanisms to prevent unexpected release of the handle during use. The nature of the attachment configuration does not require extremely high tolerance manufacturing or a large number of parts and so the production of the device would be relatively economical and the simplicity of design would result in low maintenance costs.

17 Claims, 7 Drawing Sheets

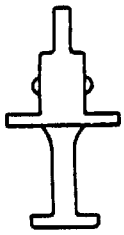
Fig. 9A
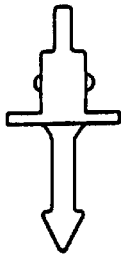
Fig. 9B
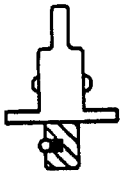
Fig. 9C
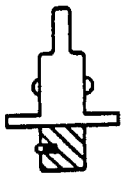
Fig. 9D
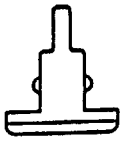
Fig. 9E
Fig. 10A
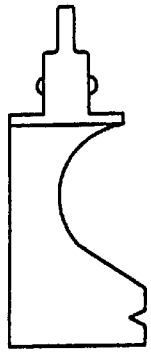
Fig. 10B
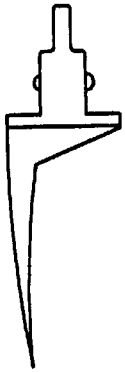
Fig. 10C
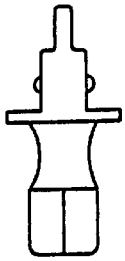
Fig. 10D
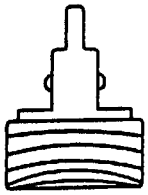
Fig. 10E
Fig. 11A
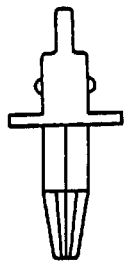
Fig. 11B
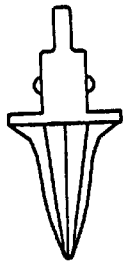
Fig. 11C
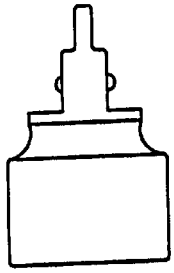
Fig. 11D
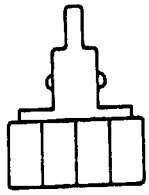
Fig. 11E

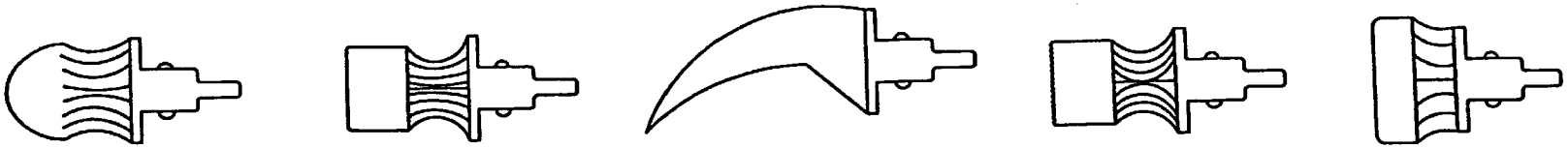
Fig. 12A
Fig. 12B
Fig. 12C
Fig. 12D
Fig. 12E
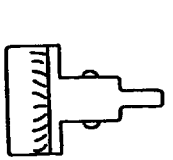
Fig. 13A
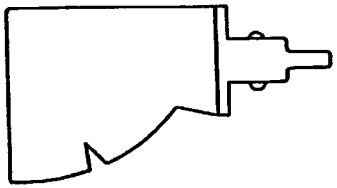
Fig. 13B
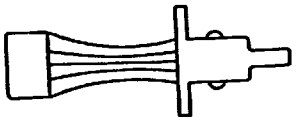
Fig. 13C
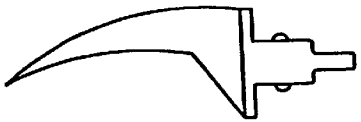
Fig. 13D
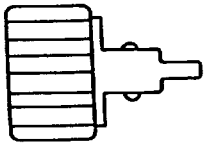
Fig. 13E
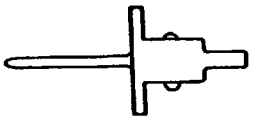
Fig. 14A
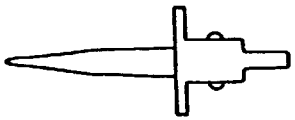
Fig. 14B
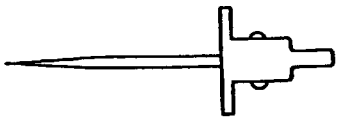
Fig. 14C
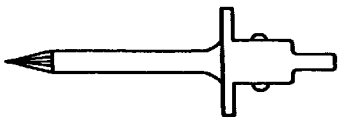
Fig. 14D
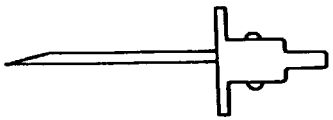
Fig. 14E

MULTI-PURPOSE HAND TOOL WITH MULTIPLE INTERCHANGEABLE UTILITY HEADS AND SAFETY LOCK

BACKGROUND OF THE INVENTION

1. Field of the Invention

The present invention relates to a new and improved multi-purpose hand tool with multiple interchangeable utility heads. More particularly, the present invention relates to a device which enables selective tool configuration by providing a durable, versatile, and economically produced professional hand tool that is compact and provides maximum safety features for high demand usage.

2. Description of the Related Art

Today's growing housing market and service and repair industry is placing a great demand upon construction and repair professionals for quick and efficient performance which often require long hours in difficult physical conditions. The rigors of various professions are often exacerbated by the weight and bulk of hand tools which must be necessarily carried upon persons when climbing ladders, scaffolds and in tight spaces. This places an increased burden upon physical stamina and endurance, decreases maneuverability and balance, and sometimes compromises safety on the job. In such settings, multi-purpose hand tools represent an effective means of reducing load weight, while providing the user with an effective means of having selective tool configurations readily available.

Such a multi-purpose hand tool may be readily adapted to circumstances which require specialty tools such as auto body repair, or other metal-working uses such as sheet metal fabrication and installation, where multi-purpose, interchangeable utility tools might speed the process and reduce space requirements for storage and quick access to tools.

The necessity and usefulness of hand tools with interchangeable heads are well known. Examples of different types and kinds of devices with interchangeable heads are disclosed in U.S. Pat. Nos. 4,183,385, 4,399,978, 4,440,206, 5,216,939, 5,526,719 and 5,255,575.

In general, the structure and function of most of these hand tools with interchangeable heads involve a handle permanently attached to a base frame. The base frame then provides for a means to detachably mount a utility head and secure such head in a manner which would provide safe usage of the tool. A limited number of such hand tools provide for a combined head and base frame unit which then detachably mounts to a handle as a single unit.

Hand tools with detachably mounted utility heads are known in the prior art. Such a device is described in U.S. Pat. No. 4,183,385. The device comprises a base frame/claw combination permanently fixed to a handle. The base frame has an end with a circular bore that accepts interchangeable heads which are secured by means of a yoke and a locking pin assembly.

The locking pin and associated pull tab are located in close proximity to the detachably mounted utility head. The major portion of those utility heads are meant to be used in a striking or hammering situation. During usage of an implement in these situations, there will inevitably be ill placed strikes. In the process of those missed impacts, the locking pin and pull tab are positioned in such a manner as to be easily damaged by other objects including nail heads and would render the instrument useless as a multi-use tool.

In addition, the close machining tolerances for the matching transverse bore holes located in the base frame and the longitudinal shaft portion of the interchangeable head would be extremely expensive to manufacturing. Even a small deviation may cause damage to the locking pin during striking or hammering which could damage the locking pin to the point that it could not be removed, or cause the formation of cracks in the locking pin which could make the device dangerous to the user or others nearby.

Furthermore, there is no mechanism provided which would provide for an interchangeable handle should the handle become worn or should the particular usage of the device dictate a handle made from a different material.

Therefore, it would be highly desirable to have a new and improved device and method for making same for a multi-purpose hand tool with multiple interchangeable utility heads which would provide for a safe and effective mechanism for attachment of the interchangeable utility heads so they would not be damaged by missed hits or less than perfect machine tolerances, which would supply a means that would allow interchangeable handles and would be economically manufactured.

The device described in U.S. Pat. No. 4,399,978 addresses the problem of providing a mechanism for an interchangeable handle but does not provide for interchangeable utility heads. This device teaches a tool with a combined base frame and utility head combination which has variable inclination relative to its handle. The base and utility head combination are attached to a handle by means of a latch rod.

Therefore, it would be highly desirable to have a new and improved device and method for making same for a multi-purpose hand tool with multiple interchangeable utility heads which would provide a mechanism to safely secure the base frame to a replaceable handle and at the same time provide a mechanism to safely secure interchangeable utility heads to the base frame as well.

U.S. Pat. No. 4,440,206 describes a device that addresses the problem of a detachable handle. The device provides for a number of combined base frame/utility heads. However, the combination of the base frame and the utility heads restrict the flexibility of the device and does not appreciably reduce the total bulk of the combined tools for easy storage or transportation.

Additionally, the position of the threads and collar place it in an area vulnerable to missed hits while in use as a hammering tool. Missed hits resulting in damage to the threads or collar may prevent removal of the handle or the combined base frame/utility heads.

Therefore, it would be highly desirable to have a new and improved device and method for making same for a multi-purpose hand tool with multiple interchangeable utility heads which would provide for maximum versatility with interchangeable utility heads and have a replaceable handle that would not be subject to damage from missed hits when used as a hammering tool and would be compact in size and easy to transport and store.

U.S. Pat. No. 5,216,939 provides for a hammering hand tool with a single interchangeable utility head which includes variable weights inserted into the interior housing of the base frame. The single interchangeable head again does not provide for maximum versatility of the tool.

In addition, the device does not provide for a mechanism for attachment to a replaceable handle.

Therefore, it would be highly desirable to have a new and improved device and method for making same for a multi-purpose hand tool with multiple interchangeable utility heads and a replaceable handle which would be compact, solidly constructed and easy to transport and carry.

A device for interchangeable heads is described in U.S. Pat. No. 5,255,575. The interchangeable heads are attached to the base frame by means of a wedge shaped portion which is inserted into a corresponding slot in the base frame. The tips are held in place presumably by a friction fit which may become compromised with repeated hammer hits that force the wedge shaped portion of the tip to distort or damage the corresponding slot in the base frame. If the friction fit is compromised, the tool would become dangerous to the user or others in the vicinity during use.

In addition, there is no means provided for attachment of a replaceable handle. Therefore, it would be highly desirable to have a new and improved device and method for making same for a multi-purpose hand tool with multiple interchangeable utility heads and a replaceable handle which would provide for attachment mechanisms which would remain safe to use even after multiple striking hits with the tool and which provides the user with an attachment for an interchangeable handle.

Finally, U.S. Pat. No. 5,526,710 describes a device that has a hollow base frame attached to a handle. The hollow base frame supports two hollow frame holders at opposite ends of the base frame to which various interchangeable heads may be attached. The device does not provide for any attachment mechanism between the hollow base frame and the handle and no safety mechanism to insure that the base frame does not detach from the handle when in use.

In addition, the complexity of the device necessitates close tolerances in machining and high maintenance costs for replacement of the numerous parts which would make the device relatively expensive to manufacture and maintain. Furthermore, the entire base frame and portions of the detachable heads are hollow. The effective usage of a hammering tool depends largely upon the weight of the hammering end of a hand tool. The correct balance of such a tool is essential for an ergonomically efficient tool.

Therefore, it would be highly desirable to have a new and improved device and method for making same for a multi-purpose hand tool with multiple interchangeable utility heads which would provide an attachment means between the base frame portion and the handle with safety considerations built in that would be relatively inexpensive to manufacture, maintain, and with a properly weighted hammering portion which would be ergonomically efficient.

SUMMARY OF THE INVENTION

Therefore, the principal object of the present invention is to provide a new and improved device and method for making same, for a multi-purpose hand tool with multiple interchangeable utility heads. This multi-purpose tool would allow for two utility head inserts for maximum versatility for attachment of the multiple interchangeable utility heads attached by means of a mechanism designed not to be adversely affected by missed hits or repeated hammer strikes.

It is a further object of the present invention to provide such a multi-purpose tool with built in safety features. Among the utility heads for this novel invention are chisels, scrappers and other tools which would normally be hand held. The use of these utility heads would provide expanded uses while preventing potential injury to the user from missed strikes to a hand held tool.

It is a further object of the present invention to provide such a new and improved device and method for making same, multi-purpose hand tool with multiple interchangeable utility heads that would be relatively inexpensive to manufacture and maintain.

It is yet a further object of the present invention to provide such a new and improved device and method for making same, for multi-purpose hand tool with multiple interchangeable utility heads, which would also be less bulky, versatile, easily transported and stored in a compact form when not in use.

It is yet a further object of the present invention to provide such a new and improved device and method for making same, for multi-purpose hand tool with multiple interchangeable utility heads, which when in use would retain its structural and design integrity and be operationally safe and simple during usage.

It is yet a further object of the present invention to provide such a new and improved device and method for making same, for multi-purpose hand tool with multiple interchangeable utility heads, which would provide for a replaceable handle.

It is finally a further object of the present invention to provide such a new and improved device and method for making same, for a multi-purpose hand tool with multiple interchangeable utility heads which would be properly weighted for efficient ergonomic use when used as a striking or hammering tool.

Briefly, the above and further objects of the present invention are realized by providing a new and improved multi-purpose hand tool with multiple interchangeable utility heads. This multi-purpose hand tool with multiple interchangeable utility heads would have a utility head block with two utility head block accepting portions providing for maximum versatility and result in a compact, less bulky tool for convenient transportation and storage. The utility head block is constructed of appropriate materials and is solid to better absorb force upon impact and provide for proper weighting of the tool when used as a hammering or striking tool. The attachment mechanisms are designed to maintain integrity and therefore safety, even after consecutive, frequent usage. Another safety feature is the use of utility heads designed to take the place of hand held tools, thus reducing the potential for injury to the user from missed strikes to the hand held tools. The hammer head block is also designed to safely accommodate different hammer handles for various usage demands or if handles become damaged, thus extending the usable life of the tool. More particularly, the present invention relates to a device which enables a user to selectively change the configuration of the tool that he is using so as to adapt the tool to various demands of an application by providing interchangeable multiple heads and handles which quickly and safely attach to a single head block. This makes the overall size of the tool much better suited than comparable conventional tools that it would replace. The interchangeable utility heads would be inserted into the head block by means of a guide shafts and held in place by a combination of a friction fit and ball/spring assembly. The handles would be held in place with the aid of wedges and the insertion of a shaft into a bore and tube assembly and in combination with an interchangeable handle, insures that the useful life of the tool will be lengthened. The nature of the attachment configuration does not require extremely high tolerance manufacturing or a large number of parts and so the production of the device would be relatively economical, by most current and future manufacturing techniques, and the simplicity of design would mean low, if any, maintenance costs.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 9A is a side view of an auto body dinging interchangeable utility head insert according to the present invention;

FIG. 9B is a side view of an auto body pick interchangeable utility head according to the present invention;

FIG. 9C is a side view of a ⅜ socket adapter interchangeable utility head according to the present invention;

FIG. 9D is a side view of a ½ socket adapter interchangeable utility head according to the present invention;

FIG. 9E is a side view of a blank interchangeable utility head insert according to the present invention;

FIG. 10A is a side view of a wallboard flat face interchangeable utility head insert according to the present invention;

FIG. 10B is a side view of a wallboard hatchet interchangeable utility head insert according to the present invention;

FIG. 10C is a side view of a bricklayer chipping face interchangeable utility head insert according to the present invention;

FIG. 10D is a side view of a bricklayer milled face interchangeable utility head insert according to the present invention;

FIG. 10E is a side view of a rawhide mallot interchangeable utility head insert according to the present invention;

FIG. 11A is a side view of a magnetic tack driver interchangeable utility head insert according to the present invention;

FIG. 11B is a side view of a magnetic tack setter interchangeable utility head insert according to the present invention;

FIG. 11C is a side view of a riveting cross pein interchangeable utility head insert according to the present invention;

FIG. 11D is a side view of a riveting striker interchangeable utility head insert according to the present invention;

FIG. 11E is a side view of a plastic/resin tip interchangeable utility head insert according to the present invention;

FIG. 12A is a side view of a ball pein interchangeable utility head according to insert the present invention;

FIG. 12B is a side view of a finishing striker interchangeable utility head insert according to the present invention;

FIG. 12C is a side view of a curved claw interchangeable utility head according to the present invention;

FIG. 12D is a side view of a framer interchangeable utility head according to the insert present invention;

FIG. 12E is a side view of a lead/copper/brass interchangeable utility head insert according to the present invention;

FIG. 13A is a side view of a hatchet milled face interchangeable utility head insert according to the present invention;

FIG. 13B is a side view of a hatchet blade interchangeable utility head insert according to the present invention;

FIG. 13C is a side view of a electrician striker interchangeable utility head insert according to the present invention;

FIG. 13D is a side view of a straight claw interchangeable utility head insert according to the present invention;

FIG. 13E is a side view of a rubber mallot interchangeable utility head insert according to the present invention;

FIG. 14A is a side view of a welder chipper interchangeable utility head insert according to the present invention;

FIG. 14B is a side view of a welder striker interchangeable utility head insert according to the present invention;

FIG. 14C is a side view of a (2) sided flat scrapper/chipper interchangeable utility head insert according to the present invention;

FIG. 14D is a side view of a pointed chipper interchangeable utility head insert according to the present invention;

FIG. 14E is a side view of a (1) sided flat scrapper/chipper interchangeable utility head insert according to the present invention;

DESCRIPTION OF THE PREFERRED EMBODIMENTS

Figure 1:
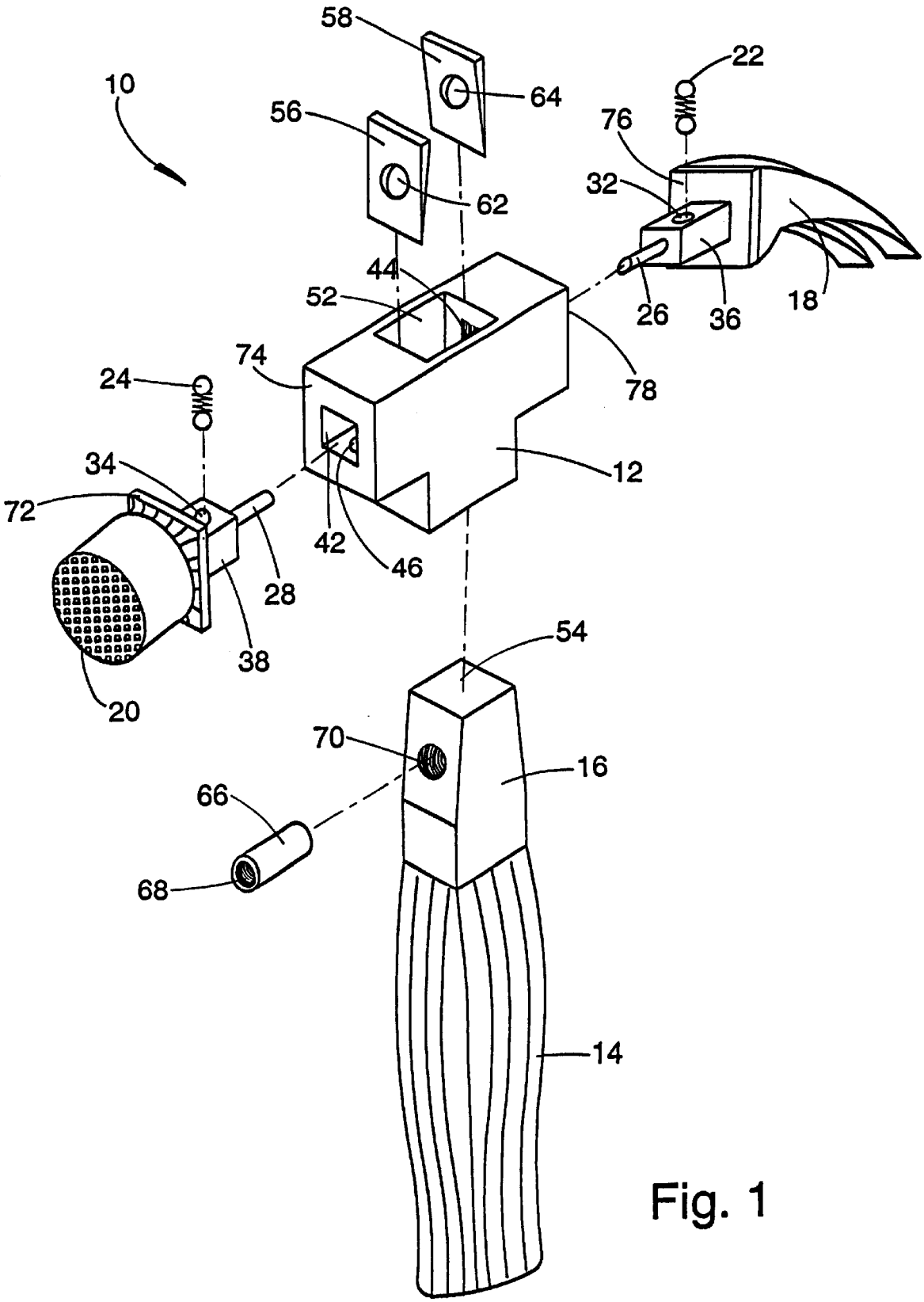
FIG. 1 is an exploded perspective elevation view of the novel multi-purpose hand tool with multiple interchangeable utility heads showing the separate elements of the device.

Referring now to the drawings, and more particularly to FIG. 1 thereof, there is shown an exploded view of a new multi-purpose striking tool with multiple interchangeable utility heads 10 which is constructed in accordance with the present invention. The new multi-purpose striking tool with multiple interchangeable utility heads 10 is used to safely, efficiently, effectively and economically provide a means of changing the tool properties by providing a number of utility heads which attach to a striking tool that is easy to maintain, transport, store and manufacture.

Referring to FIG. 1, the exploded view of the striking tool 10 is composed of a utility hammer head block 12 which attaches to a replaceable handle 14 with a utility head block accepting portion 16. The first interchangeable utility head insert 18 and a second interchangeable utility head insert 20 seen here exemplify the multitude of utility head inserts that would be available and attach to either end of the utility hammer head block 12. The ball/spring assemblies 22 and 24 are inserted into the ball/spring assembly bores 32 and 34 located on the rectangular/polygonal shafts 36 and 38 of the first interchangeable utility head insert 18 and the second interchangeable utility head insert 20. The handle accepting bore 52 on the utility head block 12 receives the utility head block accepting portion 16 of the handle 14 so that the upper portion of head block accepting portion 54 is fully inserted into the handle accepting bore 52. The securing wedges 56 and 58 are inserted on either side of the upper portion of head block accepting portion 54 in such a manner that allows the round shaft insert guide bores 62 and 64 to be in horizontal alignment with the rubber tube housing bore 70 located on the utility head block accepting portion 16 of the handle 14 and the utility head insert bores 42 and 44 located on the utility head block 12 and also the rubber tube bore 68 located in the head block accepting portion 16 of the handle 14. A rubber tube 66 with a rubber tube bore 68 is inserted into the housing bore 70 of the head block accepting portion 16 of the handle prior to insertion of head block accepting portion 16 of handle 14 into handle accepting bore 52 into the utility head block 12 and secured in place by wedges 56 and 58 when inserted on either side of the upper portion of head block accepting portion 54 when utility head block accepting portion 16 of handle 14 is inserted into handle accepting portion 52. The round shaft guides 26 and 28 located on the rectangular/polygonal shafts 36 and 38 located at one of the ends of the first interchangeable utility head insert 18 and the second interchangeable utility head insert 20 fit into either end of the rubber tube bore 68 which then provides another means to secure the handle 14 in place as well as providing a friction fit which help to secure the first interchangeable utility head insert 18 and the second interchangeable utility head insert 20 in place when in use. The rectangular/polygonal shafts 36 and 38 slide into the utility head insert bores 42 and 44 located at either end of the utility head block 12. The ball spring assemblies 22 and 24 fit securely into a multiplicity of ball accepting divots as exemplified by ball accepting divot 46 and also helping to secure the first interchangeable utility head insert 18 and the second interchangeable utility head insert 20 in place. The utility head block connection faces 74 and 78 (not shown) snugly fit against the utility head insert connection faces 72 and 76 and help to diffuse any force resulting from impact on the first interchangeable utility head insert 18 and second interchangeable utility head insert 20 when in use and acts as a stop preventing the rectangular/polygonal shaft 36 and 38 and the round guide shafts from being driven any further into the utility head block 12.

Figure 2:
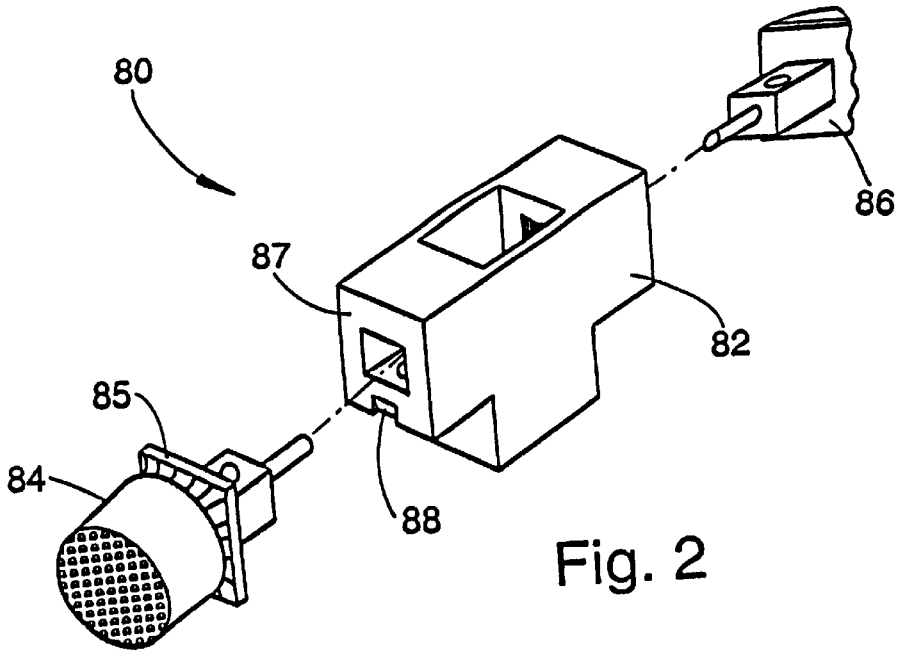
FIG. 2 is a partial close up of the perspective elevational view of an embodiment of the novel multi-purpose hand tool with multiple interchangeable utility heads device according to the present invention, with details of the pry slot configuration.

Turning now to FIG. 2 to illustrate a different embodiment of exploded view of striking tool 80 in this configuration and especially to show the optional pry slot 88 which is located on the utility head block connection face 87. When the utility head insert 84 is fully engaged and the utility head insert connection face 85 is in contact with the utility head block connection face 87, the pry slot 88 may be used to accommodate a tool tip, such as a flat screwdriver in order to give the user leverage in removing the utility head insert 84. A similar pry slot may be utilized to remove the other utility head insert 86.

Figure 3:
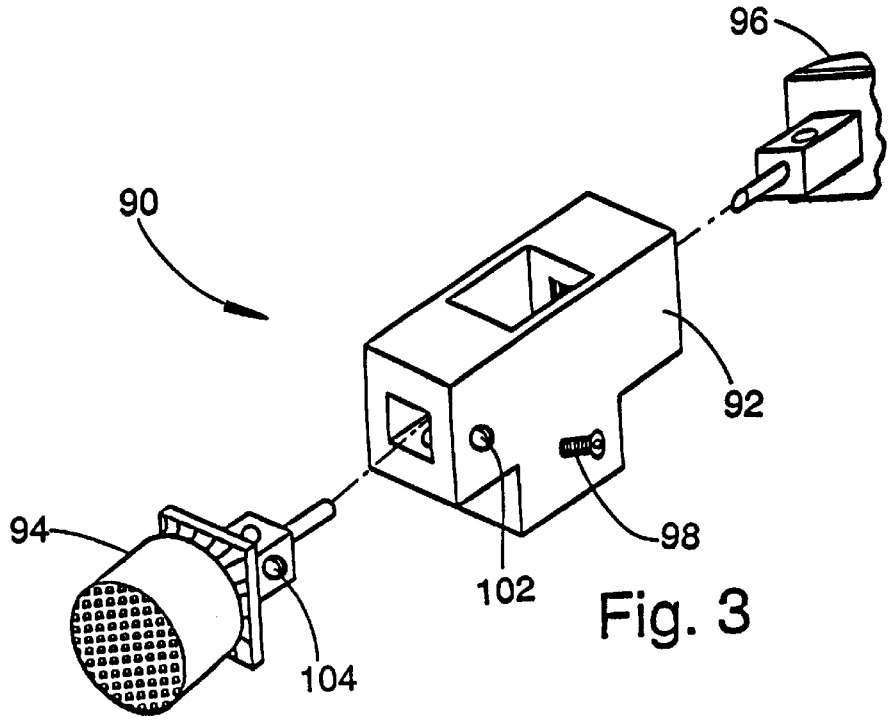
FIG. 3 is a partial close up of the perspective elevational view of one embodiment of the new and improved multi-purpose hand tool with multiple interchangeable utility heads device according to the present invention showing details of the safety set screw and corresponding set screw receiving bore.

Referring now to FIG. 3, this alternative embodiment of exploded view of striking tool 90 illustrates an optional safety set screw 98. A utility head block set screw threaded bore 102 is aligned with a utility head insert set screw bore 104 and the safety set screw 98 is screwed into place to provide yet a third safety mechanism to insure that the utility head insert 94 would not inadvertently detach from the utility head block 92 when in use. The placement of the safety set screw 98 on the utility head block 92 may be either on the side of the utility head block 92 as illustrated in FIG. 3, or on the bottom of the utility head block 92. A similar set screw may be used on the other utility head insert 96.

Figure 4:
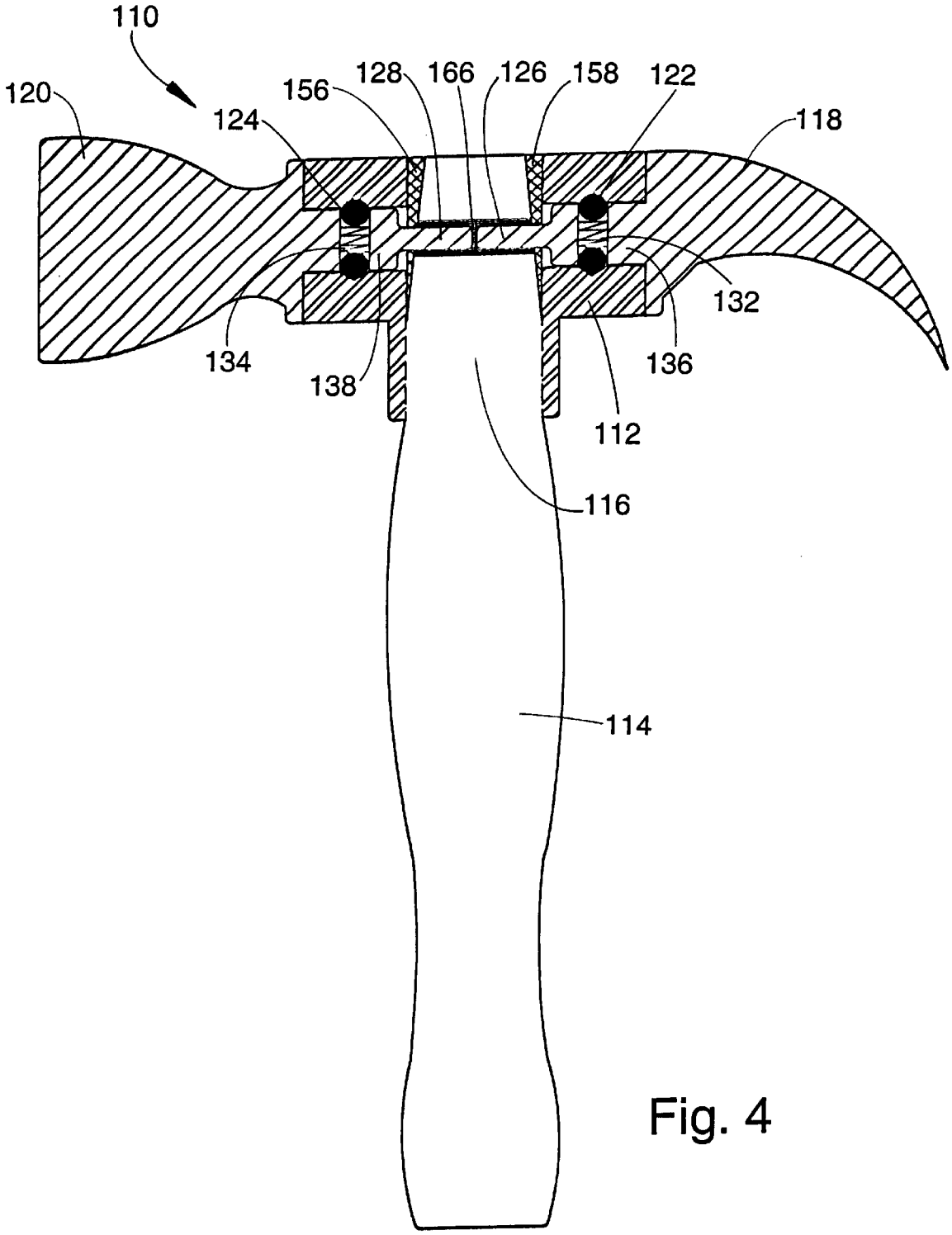
FIG. 4 is a side cut away view of the assembled novel multi-purpose hand tool with multiple interchangeable utility heads device according to the present invention.

Turning now to FIG. 4, this cut away view of an assembled striking tool 110 illustrates the utility head block accepting portion 116 of the handle 114 as it passes through the utility head block 112. The securing wedges 156 and 158 are on either side of the utility head block accepting portion 116. The rubber tube 166 secures the round guide shafts 126 and 128 of the first interchangeable utility head insert 118 and the second interchangeable utility head insert 120 in place. The ball/spring assemblies 122 and 124 inserted into the ball/spring assembly bores 132 and 134 which are located vertically through the rectangular/polygonal shafts 136 and 138 also aid in preventing unexpected dislodging of the first interchangeable utility head insert 118 and the second interchangeable utility head insert 120 when in use.

Figure 5A:
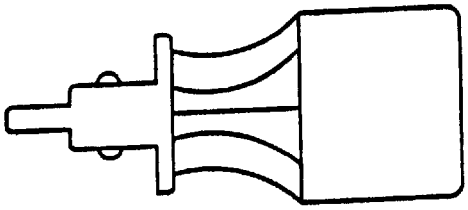
FIG. 5A is a side view of a nailer interchangeable utility head according to the present invention.
Figure 5B:
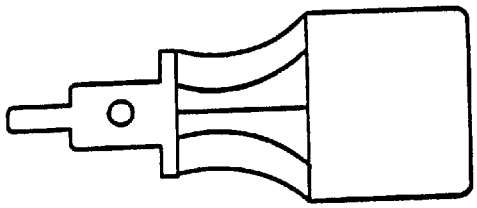
FIG. 5B is a top view of a nailer interchangeable utility head according to the present invention.
Figure 5C:
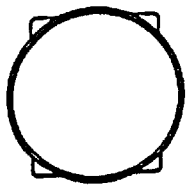
FIG. 5C is a front view of a nailer interchangeable utility head insert according to the present invention.
Figure 5D:
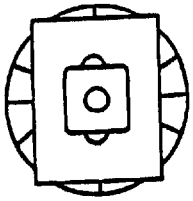
FIG. 5D is a back view of a nailer interchangeable utility head insert according to the present invention.
Figure 5E:
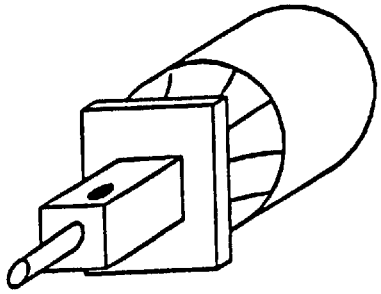
FIG. 5E is a perspective view of a nailer interchangeable utility head insert according to the present invention.

Several views of a nailer interchangeable utility head insert are shown in FIGS. 5A–E. FIG. 5A is a side view of a nailer interchangeable utility head insert according to the present invention. FIG. 5B is a top view, FIG. 5C is a front view, FIG. SD is a back view and FIG. 5E is a perspective view of a nailer interchangeable utility head insert according to the present invention.

Figure 6A:
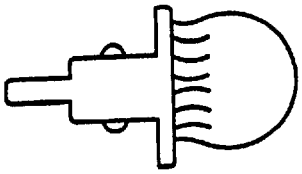
FIG. 6A is a side view of a ball pein interchangeable utility head insert according to the present invention.
Figure 6B:
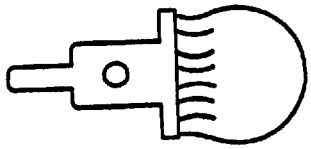
FIG. 6B is a top view of a ball pein interchangeable utility head insert according to the present invention.
Figure 6C:
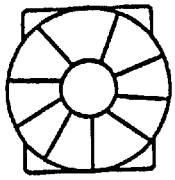
FIG. 6C is a front view of a ball pein interchangeable utility head insert according to the present invention.
Figure 6D:
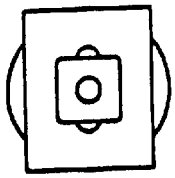
FIG. 6D is a back view of a ball pein interchangeable utility head insert according to the present invention.
Figure 6E:
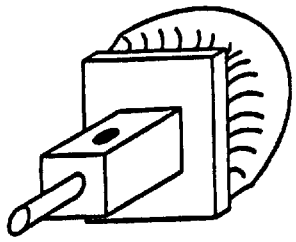
FIG. 6E is a perspective view of a ball pein interchangeable utility head insert according to the present invention.

FIGS. 6A–E illustrate several views of a ball pein interchangeable utility head insert. A side view of a ball pein interchangeable utility head insert according to the present invention is seen in FIG. 6A. FIG. 6B is a top view, FIG. 6C is a front view, FIG. 6D is a back view and FIG. 6E is a perspective view of a ball pein interchangeable utility head insert according to the present invention.

Figure 7A:
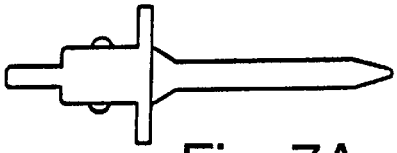
FIG. 7A is a side view of a chipper interchangeable utility head insert according to the present invention.
Figure 7B:
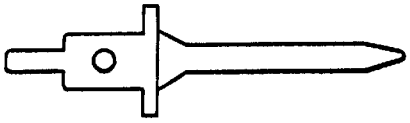
FIG. 7B is a top view of a chipper interchangeable utility head insert according to the present invention.
Figure 7C:
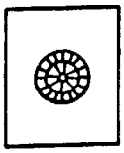
FIG. 7C is a front view of a chipper interchangeable utility head insert according to the present invention.
Figure 7D:
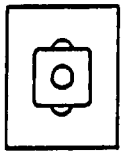
FIG. 7D is a back view of a chipper interchangeable utility head insert according to the present invention.
Figure 7E:
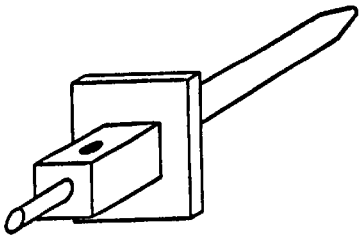
FIG. 7E is a perspective view of a chipper interchangeable utility head insert according to the present invention.
Figure 8A:
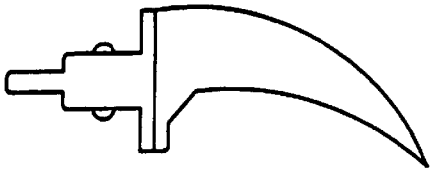
FIG. 8A is a side view of a claw interchangeable utility head insert according to the present invention.
Figure 8B:
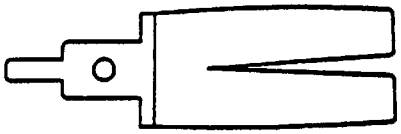
FIG. 8B is a top view of a claw interchangeable utility head insert according to the present invention.
Figure 8C:
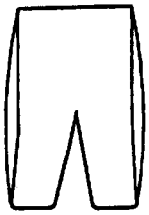
FIG. 8C is a front view of a claw interchangeable utility head insert according to the present invention.
Figure 8D:
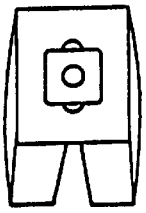
FIG. 8D is a back view of a claw interchangeable utility head insert according to the present invention.
Figure 8E:
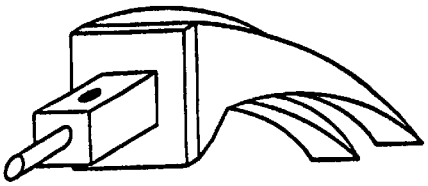
FIG. 8E is a perspective view of a claw interchangeable utility head insert according to the present invention.

In addition to hammering interchangeable utility head inserts, other types of utility heads would be beneficial to tradesmen such as carpenters and craftsmen. Several views of a chipper interchangeable utility head are illustrated in FIGS. 7A–E. FIG. 7A is a side view of a chipper interchangeable utility head according to the present invention. FIG. 7B is a top view, FIG. 7C is a front view of a chipper, FIG. 7D is a back view and FIG. 7E is a perspective view of a chipper interchangeable utility head insert according to the present invention.

Several views of a claw interchangeable utility head are illustrated in FIGS. 7A–E. FIG. 7A is a side view of a claw interchangeable utility head according to the present invention. FIG. 7B is a top view, FIG. 7C is a front view of a claw, FIG. 7D is a back view and FIG. 7E is a perspective view of a claw interchangeable utility head insert according to the present invention.

Automobile technicians and craftsmen may also benefit from the use of the use of interchangeable utility head inserts. Several side views of such utility head inserts that might be of interest are shown in FIGS. 9A–E. FIG. 9A is a side view of an auto body dinging interchangeable utility head according to the present invention. FIG. 9B is an auto body pick, FIG. 9C is a ⅜ socket adapter, FIG. 9D is a ½ socket adapter, FIG. 9E is a blank interchangeable utility head insert according to the present invention.

Side views of other interchangeable utility heads of interest to other professionals and craftsmen are seen in FIGS. 10A–E. FIG. 10A is a wallboard flat face interchangeable utility head inserts. FIG. 10B is a wallboard hatchet interchangeable utility head. FIG. 10C is a bricklayer chipping face, FIG. 10D is a bricklayer milled face interchangeable utility head insert according to the present invention and FIG. 10E is a side view of a rawhide mallet interchangeable utility head insert.

FIGS. 11A–11E show side views of more specialty interchangeable utility head inserts. FIG. 11A is a magnetic tack driver, FIG. 11B is a magnetic tack setter, FIG. 11C is a side view of a riveting cross pein, FIG. 11D is a riveting striker interchangeable utility head insert according to the present invention and FIG. 11E is a side view of a plastic/resin tip interchangeable utility head insert.

More specialty tips of interest to professional craftsmen are illustrated in FIGS. 12A–E. FIG. 12A is a side view of a ball pein interchangeable utility head according to the present invention. Side views of other interchangeable utility head inserts are FIG. 12B a finishing striker, FIG. 12C a curved claw, FIG. 12D a framer, and FIG. 12E is a lead/copper/brass interchangeable utility head insert.

The applications of the present invention are unlimited. FIGS. 13A–E illustrate side views of more interchangeable utility head inserts which might be useful to craftsmen and serious professionals. FIG. 13A is a hatchet milled face interchangeable utility head insert. FIG. 13B is a hatchet blade, FIG. 13C is an electrician striker, FIG. 13D is a straight claw and FIG. 13E is a side view of a rubber mallot interchangeable utility head insert.

Welders and metalworkers will also benefit from the present invention. More side views of interchangeable utility head inserts are shown in FIGS. 14A–E. FIG. 14A is a welder chipper, FIG. 14B is a welder striker, FIG. 14C is a (2) sided flat scrapper/chipper interchangeable utility head insert. FIG. 14D is a side view of a pointed chipper, FIG. 14E is a (1) sided flat scrapper/chipper interchangeable utility head insert according to the present invention.

It should be understood, however, that even though these numerous characteristics and advantages of the invention have been set forth in the foregoing description, together with details of the structure and function of the invention, the disclosure is illustrative only, and changes may be made in detail, especially in matters of shape, size, weight, composition, materials used in construction, configuration, manufacturing and assembly techniques, and arrangement of parts within the principal of the invention to the full extent indicated by the broad general meaning of the terms in which the appended claims are expressed.

What is claimed is:

1. A multi-function hand tool comprising:

a) interchangeable multi-purpose utility heads means;

b) utility head accepting block means, wherein said interchangeable multi-purpose utility heads means include integral ball/spring assemblies and said utility head accepting block includes corresponding divots for accepting said ball/spring assemblies;

c) a replaceable handle having a utility head accepting block portion for mounting said utility head block; and d) safety locking means, wherein said safety locking means includes wedges which friction fit snugly between said handle having a utility head accepting block portion for mounting said utility head block and said utility head accepting block, whereby said wedges have centrally located apertures for accepting said interchangeable multi-purpose utility heads means, such that when said utility heads are mounted on said utility head block said block is securely and safely locked onto said handle;

whereby when said interchangeable utility heads are inserted into said utility head accepting block, said accepting block and said utility heads are locked into place securely on said handle for the purpose of enhancing the safety of a user employing the multi-purpose hand tool for an application.

2. The multi-function hand tool according to claim 1, wherein said interchangeable multi-purpose utility heads means includes utility heads having a round shaft insertion guide rod integrally constructed thereon.

3. The multi-function hand tool according to claim 2, wherein said interchangeable multi-purpose utility heads means includes utility heads for striking, pounding and hammering functions.

4. The multi-function hand tool according to claim 2, wherein said interchangeable multi-purpose utility heads means includes utility heads for scraping, picking and chiseling functions.

5. The multi-function hand tool according to claim 2, wherein said interchangeable multi-purpose utility heads means includes utility heads for shaping, removing fasteners and cutting functions.

6. The multi-function hand tool according to claim 2, wherein said utility head accepting block means includes utility head insertion bores for accepting said utility heads, whereby said round shaft insertion guide rods are inserted into said insertion bores.

7. The multi-purpose hand tool according to claim 2, wherein said handle having a utility head accepting block portion for mounting said utility head block includes a tube housing bore, and a rubber tube which is inserted into said tube housing bore, whereby when said utility heads are inserted into said utility head accepting block, said insertion guide rods fit snugly into said rubber tube in place within said tube housing bore in said handle.

8. The multi-function hand tool according to claim 1, wherein said utility head accepting block means includes a pry slot means integrally constructed into said utility accepting block for enhancing the removal of a tightly attached interchangeable multipurpose utility head.

9. The multi-function hand tool according to claim 1, wherein said utility head accepting block means includes a set screw accepting threaded bore and a set screw, and wherein said utility head includes a set screw accepting bore, whereby upon tightening of said set screw, the secure attachment of said utility head is greatly enhanced.

10. The multi-function hand tool according to claim 1, wherein the manufactured weight of said utility head accepting block means and the manufactured weight of said interchangeable multi-purpose utility heads means can be varied to accommodate any weight requirements for any hammering or striking applications.

11. A multi-function hand tool comprising:

a) utility head means for accepting socket tools;

b) utility head accepting block means, wherein said interchangeable multi-purpose utility heads means include integral ball/spring assemblies and said utility head accepting block includes corresponding divots for accepting said ball/spring assemblies;

c) a replaceable handle having a utility head accepting block portion for mounting said utility head block; and d) safety locking means, wherein said safety locking means includes wedges which friction fit snugly between said handle having a utility head accepting block portion for mounting said utility head block and said utility head accepting block, whereby said wedges have centrally located apertures for accepting said interchangeable multi-purpose utility heads means, such that when said utility heads are mounted on said utility head block said block is securely and safely locked onto said handle;

whereby when said interchangeable utility heads are inserted into said utility head accepting block, said accepting block and said utility heads are locked into place securely on said handle for the purpose of enhancing the safety of a user employing the multi-purpose hand tool for an application.

12. The multi-function hand tool according to claim 11, wherein said utility head means for accepting socket tools includes utility heads having a round shaft insertion guide rod integrally constructed thereon.

13. The multi-function hand tool according to claim 12, wherein said utility head means for accepting socket tools includes utility heads which readily accept metric and standard socket tools.

14. The multi-function hand tool according to claim 12, wherein said utility head accepting block means includes utility head insertion bores for accepting said utility heads, whereby said round shaft insertion guide rods are inserted into said insertion bores.

15. The multi-function hand tool according to claim 12, wherein said utility head means for accepting socket tools include integral ball/spring assemblies and said utility head accepting block includes corresponding divots for accepting said ball/spring assemblies such that when inserted said utility head is securely connected to said utility head accepting block.

16. The multi-function hand tool according to claim 11, wherein said utility head accepting block means includes a pry slot means integrally constructed into said utility accepting block for enhancing the removal of a tightly attached interchangeable multipurpose purpose utility head.

17. The multi-function hand tool according to claim 11, wherein said utility head accepting block means includes a set screw accepting threaded bore and a set screw, and wherein said utility head means for accepting socket tools includes a set screw accepting bore, whereby upon tightening of said set screw, the secure attachment of said utility head means is greatly enhanced.

* * * * *